US010401010B2

(12) United States Patent
Gallion et al.

(10) Patent No.: US 10,401,010 B2
(45) Date of Patent: Sep. 3, 2019

(54) NICHE BACKLIGHTING APPARATUS

(71) Applicant: Backlit Tile Kit, LLC, Spokane Valley, WA (US)

(72) Inventors: Jacob Gallion, Spokane Valley, WA (US); Matthew Barry, Spokane Valley, WA (US)

(73) Assignee: Backlit Tile Kit, LLC, Spokane Valley, WA (US)

( * ) Notice: Subject to any disclaimer, the term of this patent is extended or adjusted under 35 U.S.C. 154(b) by 122 days.

(21) Appl. No.: 15/390,398

(22) Filed: Dec. 23, 2016

(65) Prior Publication Data

US 2018/0180230 A1 Jun. 28, 2018

(51) Int. Cl.

| | |
|---|---|
| ***F21S 8/02*** | (2006.01) |
| ***F21V 23/00*** | (2015.01) |
| ***F21V 3/04*** | (2018.01) |
| ***F21V 23/04*** | (2006.01) |
| ***F21V 31/00*** | (2006.01) |
| ***F21V 33/00*** | (2006.01) |
| *F21V 23/06* | (2006.01) |
| *F21V 3/06* | (2018.01) |
| *F21W 131/405* | (2006.01) |
| *F21Y 115/10* | (2016.01) |
| *F21Y 115/20* | (2016.01) |
| *F21Y 115/15* | (2016.01) |
| *F21Y 107/00* | (2016.01) |

(52) U.S. Cl.

CPC ..... *F21V 23/0435* (2013.01); *F21V 31/00* (2013.01); *F21V 33/006* (2013.01); *F21V 3/0625* (2018.02); *F21V 23/06* (2013.01); *F21W 2131/405* (2013.01); *F21Y 2107/00* (2016.08); *F21Y 2115/10* (2016.08); *F21Y 2115/15* (2016.08); *F21Y 2115/20* (2016.08)

(58) Field of Classification Search

CPC ..... F21S 8/024; F21V 3/0625; F21V 23/0435

See application file for complete search history.

(56) References Cited

U.S. PATENT DOCUMENTS

| | | | | |
|---|---|---|---|---|
| 4,546,419 | A * | 10/1985 | Johnson | F21S 8/02 200/310 |
| 6,755,550 | B1 * | 6/2004 | Lackey | F21S 8/024 362/147 |
| 2005/0024856 | A1 * | 2/2005 | Helenowski | F21S 8/024 362/147 |
| 2005/0257436 | A1 * | 11/2005 | Vanderpol | E04F 19/086 52/28 |
| 2009/0094734 | A1 * | 4/2009 | Diebel | E04H 4/0043 4/506 |

(Continued)

OTHER PUBLICATIONS

HGTV, Shower niche with white basket weave tile, Dec. 24, 2015, HGTV.com (Year: 2015).*

*Primary Examiner* — Alexander K Garlen
*Assistant Examiner* — Eric T Eide
(74) *Attorney, Agent, or Firm* — Lee & Hayes, P.C.

(57) ABSTRACT

An apparatus includes a frame having an inner cavity, and a first substrate disposed at a backing panel of the inner cavity of the frame. The first substrate includes an array of light generating sources. The apparatus further includes a second substrate overlaying the first substrate. The second substrate is translucent, and the second substrate is a material to which a tiling adhesive adheres.

16 Claims, 5 Drawing Sheets

(56) References Cited

U.S. PATENT DOCUMENTS

| | | | | |
|---|---|---|---|---|
| 2014/0376214 | A1* | 12/2014 | Barry | F21V 33/006<br>362/147 |
| 2015/0062859 | A1* | 3/2015 | Kimberley | F21S 9/03<br>362/1 |
| 2017/0119078 | A1* | 5/2017 | Chen | A42B 3/044 |

* cited by examiner

NICHE BACKLIGHTING APPARATUS

BACKGROUND

Homeowners often desire their living quarters and rooms to be aesthetically pleasing, welcoming, and inviting. To achieve such, homeowners may remodel or decorate certain rooms throughout a house, such as a kitchen or bathroom. However, certain rooms, such as a bathroom, may present certain difficulties that limit the degree to which the space can be personalized. For instance, bathrooms may contain tight spaces, include costly materials, or require increased water-proofing.

Within a bathroom, one such remodel may include inserting a shower niche into a shower. Often overlooked during a remodel, a shower niche is a recessed portion of a wall within the shower, that provides a space where items commonly used during a shower may be placed (soap, shampoo, etc.).

Due to a lack of options in remodeling shower niches, or alternatively, the tight spaces involved in the shower, builders and/or homeowners may overlook customizing this space for various reasons. In addition, homeowners may resist installing lighting within a shower niche given the wet environment of the shower and the hazard of electrical shock.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features. Furthermore, the drawings may be considered as providing an approximate depiction of the relative sizes of the individual components within individual figures. However, the drawings are not to scale, and the relative sizes of the individual components, both within individual figures and between the different figures, may vary from what is depicted. In particular, some of the figures may depict components as a certain size or shape, while other figures may depict the components on a larger scale or differently shaped for the sake of clarity.

DETAILED DESCRIPTION

Overview

This disclosure is directed to the implementation of a wall niche in a building structure. More specifically, the apparatus described herein may be implemented in a shower in a bathroom. The apparatus serves as backlighting for a wall niche in view of a desire to improve the aesthetic appeal of a shower or other building space and/or improve the lighting of the space. While this embodiment describes a backlit shower niche, it is to be appreciated that this apparatus may be used within any recessed portion of a wall in which a person desires to improve the aesthetic appeal and/or improve lighting. A shower niche is a recessed portion of a wall within the shower, that provides a space where items commonly used during a shower may be placed (soap, shampoo, etc.). The apparatus is described with respect to the figures as follows.

Figure 1:
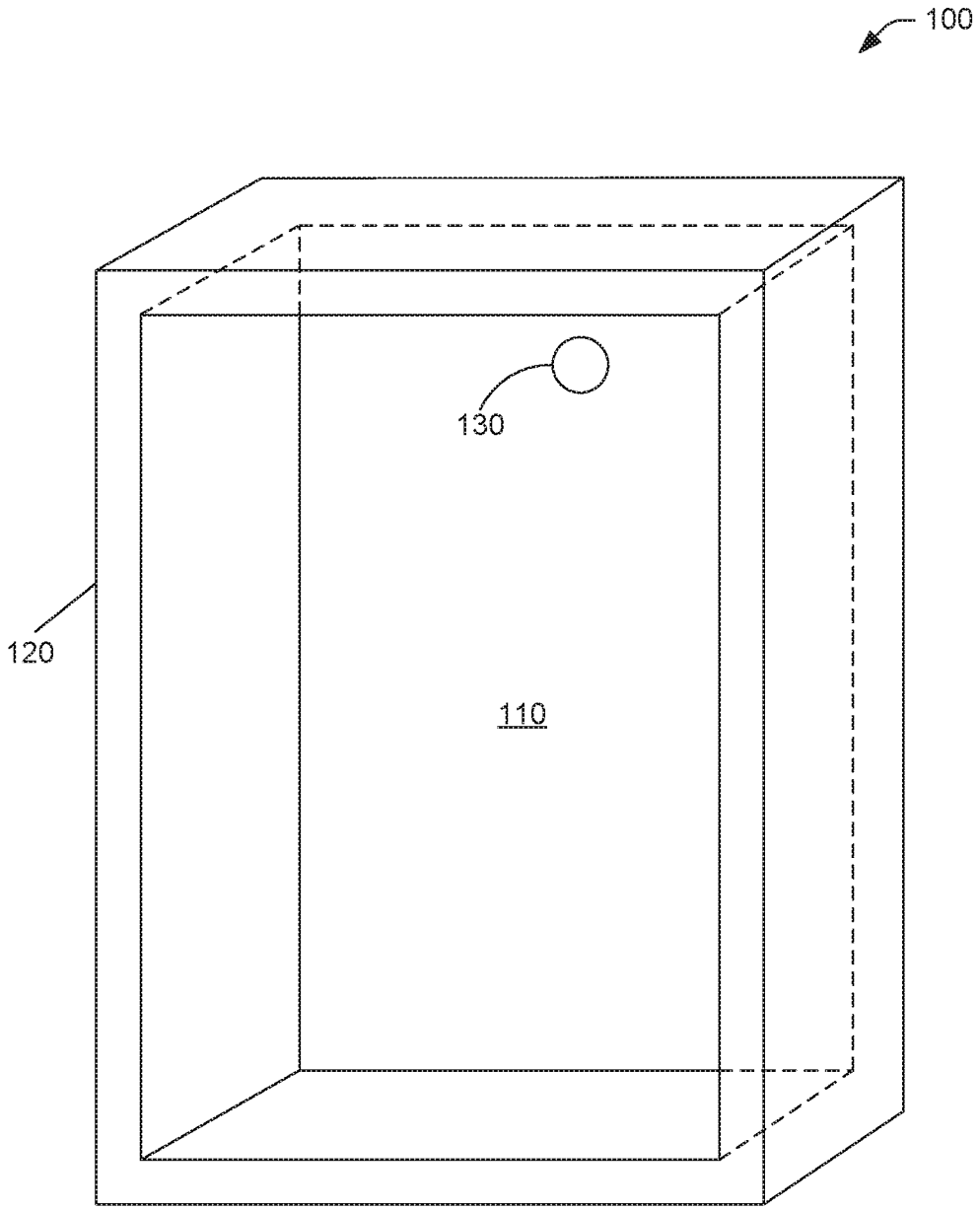
FIG. 1 illustrates an isometric view of a wall niche according to an embodiment of this application.

FIG. 1 depicts an isometric view of an embodiment of a frame 100 for a wall niche. In some instances, a wall niche is formed by cutting out a section of a wall to expose a void in the wall. Conventionally, a builder may then build or insert a pre-built structure for support. The frame 100 may serve as a support structure in which other components of the apparatus are installed, which are discussed further herein below. In this embodiment, the frame 100 may include a prefabricated high density foam. In other embodiments, the frame 100 may include materials such as wood, metal, polymer, etc. Furthermore, although the frame is depicted as being substantially rectangular, the frame 100 is not limited to rectangular. Rather, the frame may be of any shape or geometry desired that can be accommodated within a recessed portion of a wall.

The frame 100 may include a back wall ("backing panel") 110 and sidewalls 120 that extend from each edge of the backing panel 110. Sidewall 120 may extend a uniform distance from the backing panel 120, such that the length of each sidewall 120 is equal, thus creating a uniform depth from the front of the frame 100 to the backing panel 110 and thereby forming an inner cavity depicted in FIG. 1. In some embodiments (not shown), the sidewalls may be of different lengths, thus creating a non-uniform cavity depth. Still further, in other embodiments, the niche may have one or more inner cavities forming compartments having one or more depths.

Located within the back wall 110 of the frame 100 is a hole 130 that allows the passage of electrical wiring that powers an array of lighting elements, such as light-emitting diodes ("LEDs") (see FIG. 2), for example. In the instant embodiment, the hole 130 is located within the backing panel 110. In other embodiments, the hole 130 may be located within any region of the backing panel 110 or within any of the sidewalls 120 such that electrical wires may pass through to supply power to the array of lighting elements.

Figure 2:
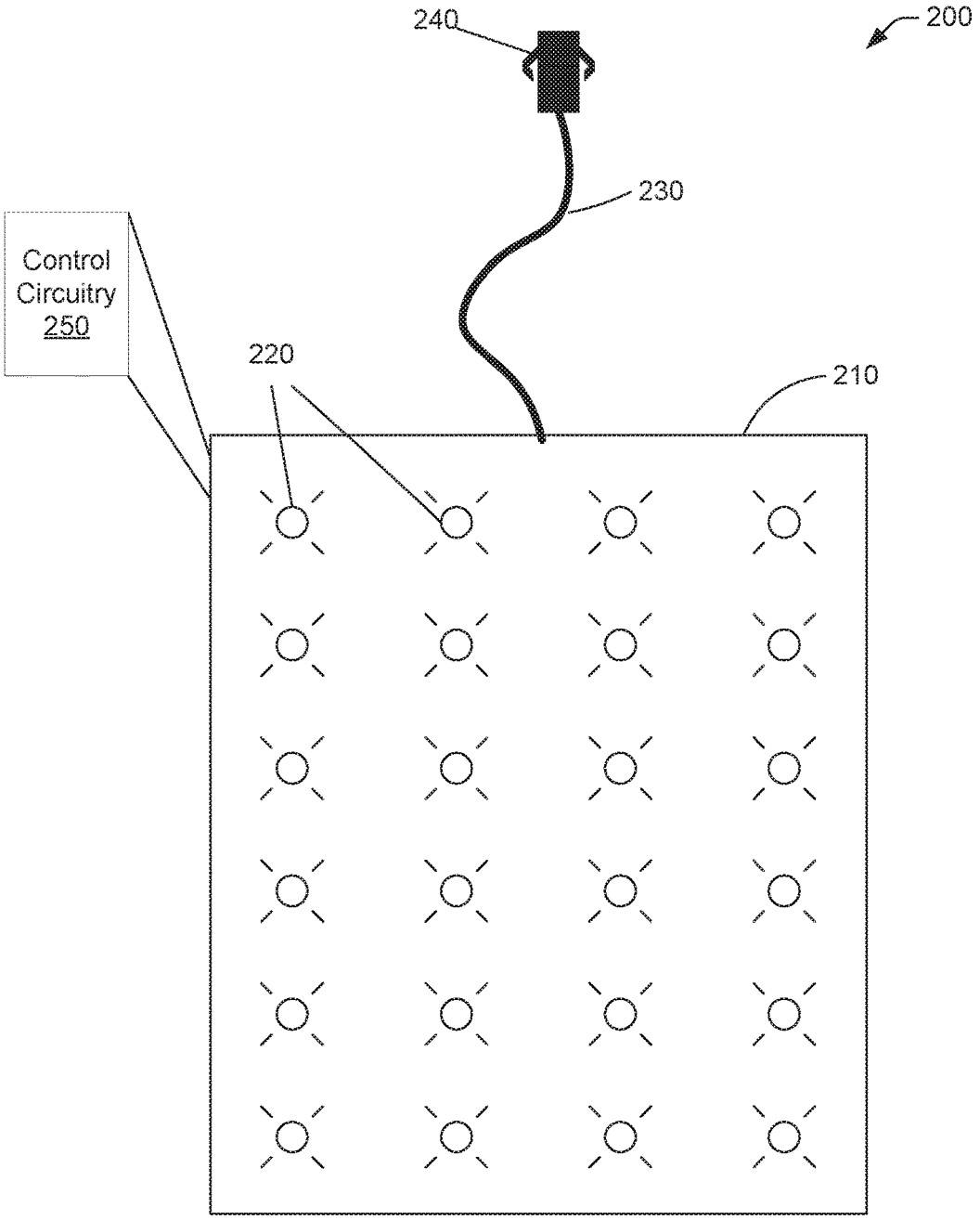
FIG. 2 illustrates an embodiment of an array of light sources according to this application.

FIG. 2 depicts a front view of a circuit panel 200. The circuit panel may include a substrate 210 and an array of lighting elements 220 disposed thereon. As shown, the substrate 210 may be substantially rectangular to correspond with the shape of the frame depicted in FIG. 1, for convenience. However, in other embodiments, the substrate 210 may correspond to any shape of the backing panel 110 of the frame 100 into which the circuit panel 200 is to be implemented. The substrate 210 may be made from a plurality of materials, including thin plastic or aluminum as they are lightweight and economical materials. Other materials that may be used as the supporting substrate 210 include metals (besides aluminum), alloys, wood, polymers, etc. In an embodiment, the substrate 210 is shown to be a uniform solid material, however, in other embodiments the substrate may be non-uniform or may contain voids in the substrate 210. Moreover, the array may be formed by a plurality of smaller sections of circuit panel that are electrically connected prior to or during installation of the wall niche, such as linear strips of lighting elements, which may be implemented as individual strips or may be connected together with other strips to form a full array of lighting elements across one or more portions of the frame (see FIGS. 4 and 5). Furthermore, it is contemplated that the array of lighting elements may be disposed directly in the backing panel of the frame, or in the sides, as strips as well.

As stated above, the substrate 210 includes lighting elements 220 that create a backlit environment behind a tiled surface in the wall niche. In an embodiment, the lighting elements 220 may include light-emitting diodes (LEDs). It is noted, however, that the lighting elements 220 may include one or more of: LEDs, organic light-emitting diodes (OLED), thin-film EL (TFEL), or any other luminescent element that is suitably sized for lighting the wall niche, according to the features of this application. While the lighting elements 220 are depicted as arranged in a uniformly distributed array, it is noted that the lighting elements 220 may be arranged in any pattern desired. It is also to be appreciated that a single light source may be used to produce the backlight of the apparatus.

The lighting elements 220 of the circuit panel 200 may be configured to display any color of light. Furthermore, the lighting elements 220 may all display one uniform color or each individual lighting element 220 may display a different color entirely. Furthermore, the lighting elements 220 may each be configured to change colors, for example, by using a cluster of different colored LEDs for one or more individual lighting elements 220. In other embodiments, the lighting elements 220 may be dimmed together or individually. Additionally, the lighting elements 220 may be configured to respond to sounds in the environment. In such an embodiment (not shown), the wall niche apparatus would require further audio receiving and decoding technology configured to communicate with the array of lighting elements. It should also be noted that the lighting elements 220 may also be configured to display various animations, such as wave-like patterns, burst patterns, etc.

Further depicted in FIG. 2 is the electrical wiring 230 and locking connector 240. The electrical wiring is coupled to the plurality of lighting elements 220 disposed within the substrate 210 and supplies power to the lighting elements 220. The wiring 230 may be any length desired, thus accommodating a length needed to connect the circuit panel 200 to a power supply.

In an embodiment, the electrical wiring 230 is shown coupled to a locking connector 240. The locking mechanism allows for a secure connection when connected to a hardwire line. In some embodiments, the electrical connection may be configured to connect to a ground-fault circuit interrupter (GFCI) outlet or other standard electrical outlets. Furthermore, the circuit panel 200 may be configured to operate via power supplied by a battery, wireless power transfer, etc.

Further depicted in FIG. 2 is control circuitry 250 coupled to the circuit panel 200. The control circuitry 250 allows the lighting elements 220 to be controlled via a wireless remote, described further herein below.

Figure 3:
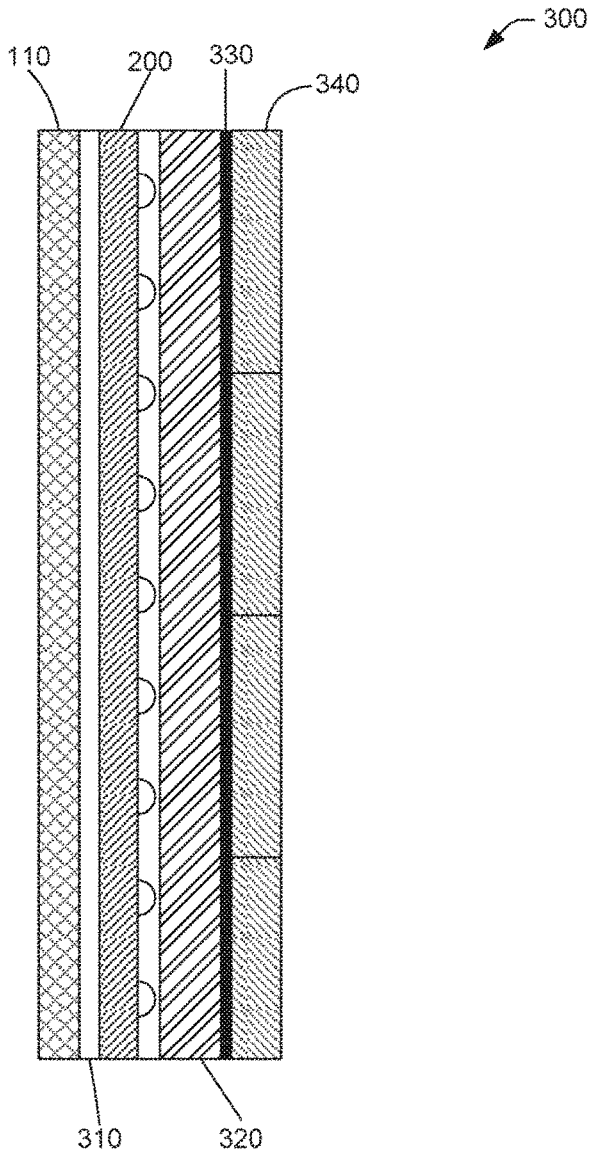
FIG. 3 illustrates a cross-sectional view of a rear section of the wall niche as installed.

FIG. 3 depicts a cross-sectional view of components of a wall niche apparatus 300 and their relative positions with respect to each other. The cross section is shown along line segment A-A depicted in FIG. 4. Further, FIG. 3 shows an example of assembly of the apparatus 300, however, it is noted that other arrangements and/or configurations are contemplated. Beginning on the left-hand side, FIG. 3 depicts the backing panel 110 of frame 100 previously discussed (see FIG. 1). The frame 100 may serve as the support structure of the wall niche.

Apparatus 300 may further include an adhesive 310 applied to the backing panel 110 of the frame 100. The adhesive 310 allows for the circuit panel 200 to be adhered to the backing panel 110 of the frame. Additionally, and/or alternatively, in an embodiment not shown, at least a portion of the circuit panel 200 may be adhered to one or more of the sidewalls 120 of the frame, as well as the backing panel 110; or the circuit panel 200 may be entirely adhered to one or more of the sidewalls 120. The adhesive may be one of: cyanoacrylate, epoxy, resin, elastomer, or any other adhesive that serves as an adherent to the support structure material without interfering with the circuitry. In an alternative embodiment, the adhesive may be omitted and the circuit panel 200 may be attached to the frame via a mechanical means, such as for example, an interference fit, mechanical fasteners (e.g., hook and loop fasteners, staples, nails, screws, etc.), inserted into slots within the frame (not shown), etc.

As previously mentioned, the adhesive 310 allows for the circuit panel 200 to be disposed on the backing panel 110 of the frame 100. FIG. 3 further depicts a substrate 320 disposed on the light emitting side of the circuit panel 200. The substrate 320 may be a translucent material, allowing passage of light while also diffusing light. Alternatively, the substrate 320 may also be transparent. The substrate 320 may also be transparent. Furthermore, as described further herein below, whether implemented as a standard wall niche or a shower niche, apparatus 300 may be configured to receive tiles thereon for protective and/or aesthetic purposes. As such, the outward facing surface of the substrate 320 may be configured to receive and maintain tile thereon. In an embodiment, the material of the substrate 320 may be a material to which a tiling adhesive, such as mortar, adheres. For example, the substrate 320 may be one of: acrylic, polycarbonate, polyvinyl chloride, polyethylene terephthalate, or any other material to which a tiling adhesive adheres. Additionally, and/or alternatively, a surface of the substrate 320 may have textural features that assist in both diffusing the light from the array of lighting elements, as well as providing micro cavities to which the tiling adhesive may form a more secure bond.

In the present embodiment, the substrate 320 is shaped to entirely cover the electrical panel 200. This allows the substrate 320 to serve as a barrier between the lighting elements and the tiling adhesive (described in further detail below). The substrate 320 may also create a water-proof seal to prevent water damage to the circuit panel 200.

In an embodiment, as depicted in FIG. 3, a layer of tile 340 may be applied against the side of the substrate 320 that is opposite to the side facing the LEDs 220. The tile 340 may be applied to the substrate 320 via a tiling adhesive 330, such as a tiling mortar. The tiling adhesive 330 adheres to the translucent substrate 320 while additionally holding tile 340 thereon. Note to secure the tile, a plurality of different tiling adhesives may be used from available tiling adhesives known to those skilled in the art. Furthermore, the tiling adhesive 330 may be translucent so as to allow the passage of light. The tile 340 may contain transparent or translucent pieces in the tiling pattern. In various embodiments, the tile pattern may comprise a number of transparent pieces along with a number of opaque pieces so as to create a pattern comprising lit and unlit pieces.

Figure 4:
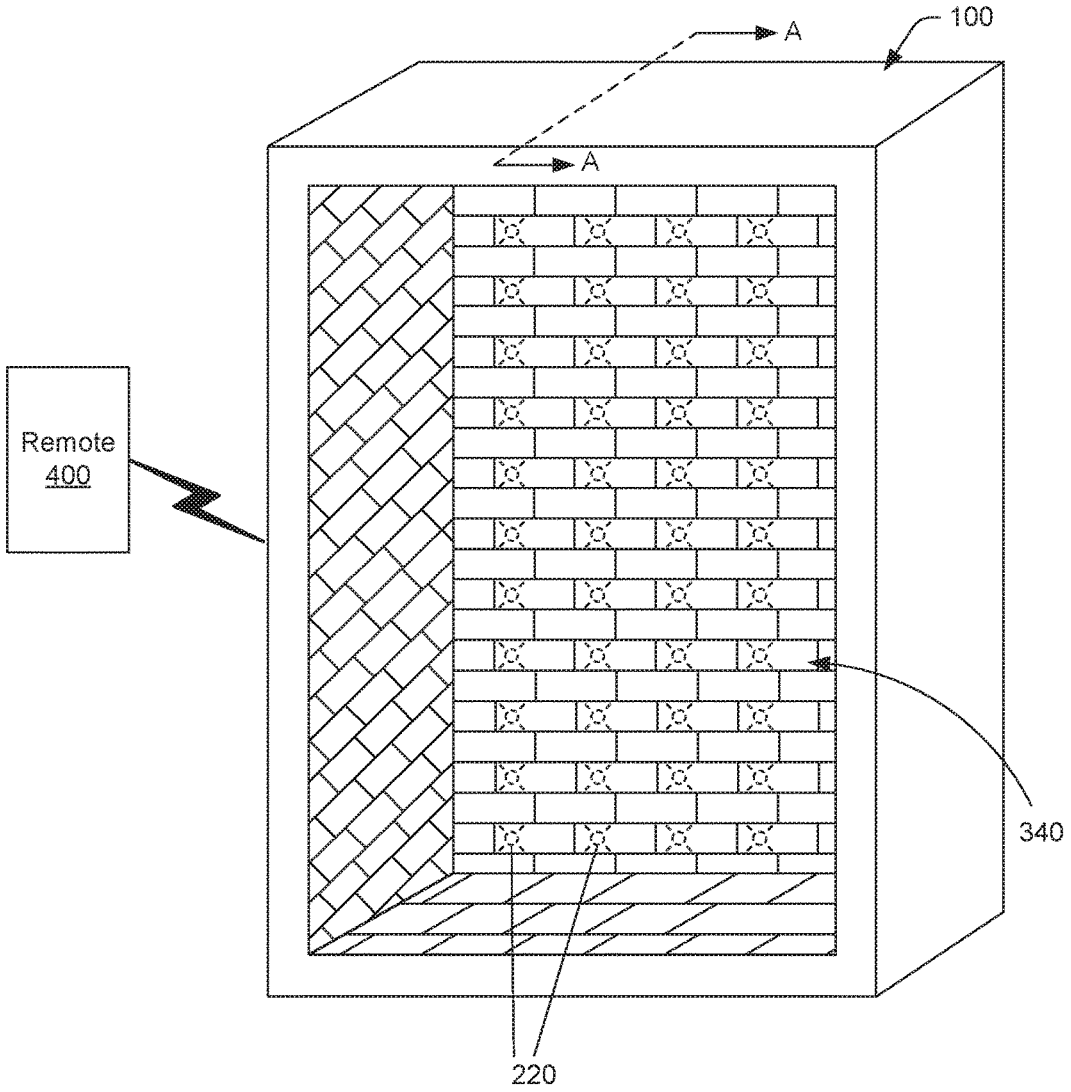
FIG. 4 illustrates an isometric view of an embodiment of the wall niche.

FIG. 4 depicts an isometric view of the wall niche apparatus with tile thereon. While the lighting elements 220 are depicted on one face of the wall niche, it is noted that, as previously mentioned, the array of lighting elements may be installed on any one or more of the sides of the inner cavity of the frame 100.

As previously mentioned in the discussion of FIG. 2, the lighting elements 220 may be configured to display a plurality of brightness levels, colors, patterns, etc. The control of these features is accomplished using a wireless remote 400. The remote 400 may control the array of lighting elements 220 via the control circuitry previously mentioned. The remote 400 may communicate with the control circuitry via Bluetooth™. Additionally, and/or alternatively, the remote 400 may be configured to communicate with the electrical panel via at least one of: local area network, internet, radio frequency, infrared frequency, or any other communication method with which a user may control lighting preferences.

Figure 5:
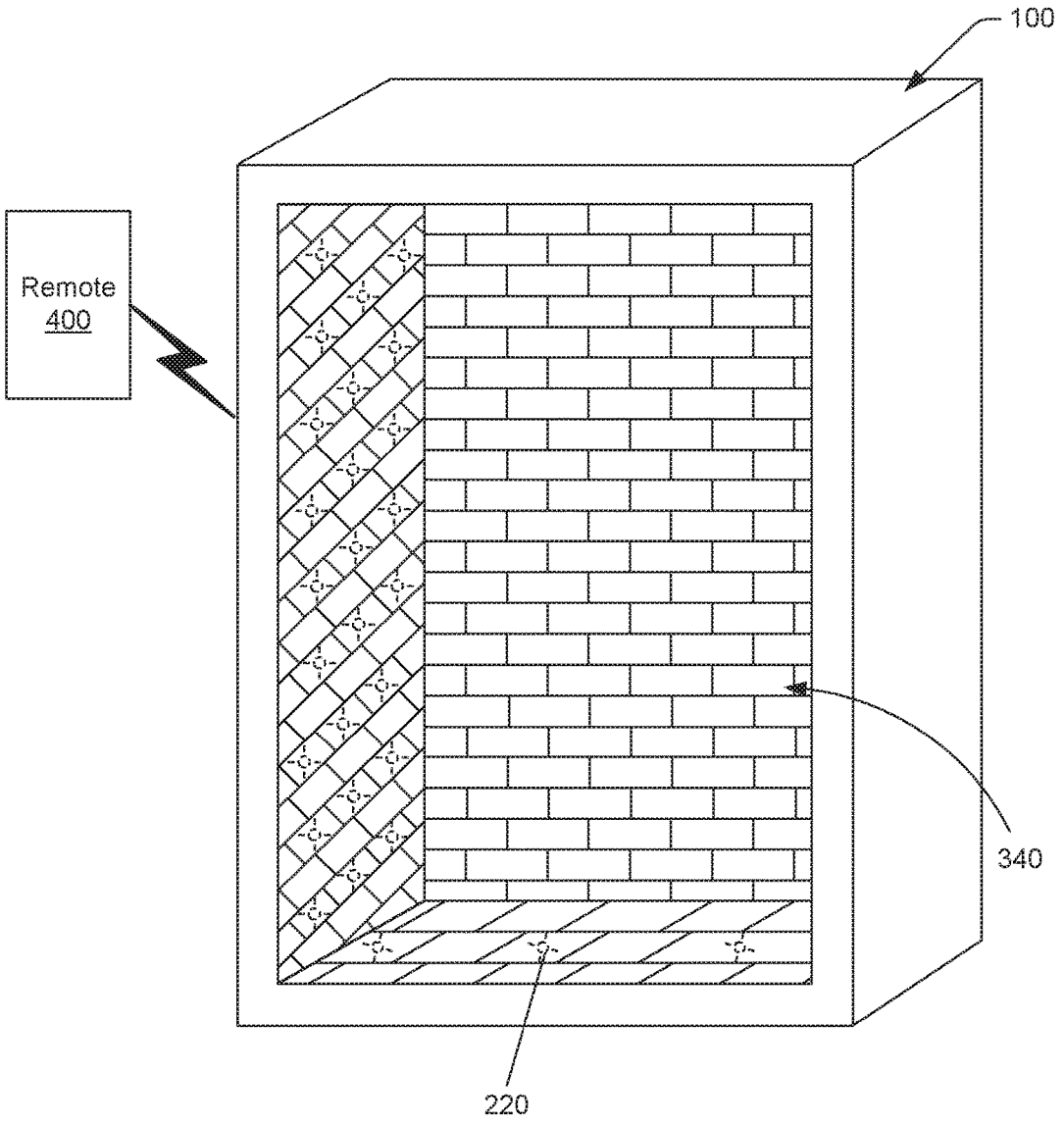
FIG. 5 illustrates an isometric view of another embodiment of a wall niche.

FIG. 5 depicts another embodiment wherein the lighting elements 220 may be disposed on the sidewalls of the frame. The embodiment depicted in FIG. 5 may contain all the elements previously disclosed in FIGS. 1-3. However, small changes may be made to individual components as to accommodate the use of lighting elements 220 on the sidewalls. For example, the substrate (element 320 in FIG. 3), which may create a barrier between the tiling adhesive and the circuit panel, may wrap around the outer edges of the frame 100 (not shown) to ensure that the circuit panel would not be exposed to environmental elements. Additionally, the hole, through which the wiring is intended to pass to supply power to the array of lighting elements, may be disposed on a sidewall, or alternatively on the backing panel still.

CONCLUSION

Although embodiments have been described in language specific to structural features and/or methodological acts, it is to be understood that the disclosure is not necessarily limited to the specific features or acts described. Rather, the specific features and acts are disclosed herein as illustrative forms of implementing the claimed subject matter.

What is claimed is:

1. A preformed niche for a method of installation in a recessed portion of a wall, the preformed niche comprising:

a frame, prefabricated for insertion directly into the recessed portion of the wall, the frame including a backing panel and a plurality of sidewalls that form an integral structure of a high density foam, the plurality of sidewalls extending a uniform distance away from the backing panel such that a first end of each sidewall adjoins the backing panel and a second end of each sidewall adjoins with the surface during the installation of the preformed niche, the plurality of sidewalls forming a cavity with the backing panel;

a circuit substrate including an array of light generating sources, the circuit substrate disposed on the backing panel at a bottom of the cavity, and the circuit substrate including an electrical power connection to connect to a power source within the wall to supply power to the array of light generating sources thereon; and a tiling substrate fixed in place in the cavity over the circuit substrate forming a water-proof seal to prevent moisture from reaching the circuit substrate, the tiling substrate being translucent and of a material to which a tiling adhesive adheres whereby tiles may be affixed thereto, and the tiling substrate being disposed in the frame such that an outward facing surface of the tiling substrate is recessed from the respective second ends of the plurality of sidewalls thereby forming a recessed shelf space along the recessed portion of the wall upon installation of the preformed niche, wherein the method of the installation of the preformed niche comprises:

inserting the preformed niche into the recessed portion of the wall;

securing the preformed niche in a fixed position;

connecting the electrical power connection to the power source within the wall;

applying the tiling adhesive to the tiling substrate and to the plurality of sidewalls;

applying at least one tile that is at least partially translucent to the tiling substrate in the cavity; and applying at least one tile to each of the plurality of sidewalls.

2. The preformed niche according to claim 1, wherein the frame includes a hole through the backing panel via which wiring from the electrical power connection of the circuit substrate passes.

3. The preformed niche according to claim 1, wherein the backing panel and the plurality of sidewalls are prefabricated of a high density foam as a unitary structure.

4. The preformed niche according to claim 1, wherein the array of light generating sources includes at least one of: light-emitting diodes (LED), organic light-emitting diodes (OLED), or thin-film EL.

5. The preformed niche according to claim 1, wherein the electrical power connection includes a locking connector configured to connect to a hardwire line within the wall.

6. The preformed niche according to claim 1, wherein a material of the tiling substrate includes one of: acrylic, polycarbonate, polyvinyl chloride, or polyethylene terephthalate.

7. The preformed niche according to claim 1, further comprising a remote to control the array of light generating sources.

8. The preformed niche according to claim 7, wherein the remote is configured to control the array of light generating sources via at least one of: Bluetooth, local area network, internet, radio frequency, or infrared frequency.

9. A preformed niche kit for a method of installation in a recessed portion of a wall, the preformed niche kit comprising:

a frame, prefabricated for insertion directly into the recessed portion of the wall, the frame including a plurality of sidewalls that form an integral structure of a high density foam, the plurality of sidewalls adjoining with the surface during installation of the preformed niche, the plurality of sidewalls forming a cavity with the backing panel;

a fastener;

a circuit substrate including an array of light generating sources, the circuit substrate sized to fasten, via the fastener, to the backing panel at a bottom of the cavity of the frame such that the circuit substrate is disposed against the cavity, and the circuit substrate including an electrical power connection for connecting to a power source within the wall to supply power to the array of light generating sources thereon;

a tiling substrate of a material to which a tiling adhesive adheres, the tiling substrate being sized for installation to be fixed in place in the cavity over the circuit substrate forming a water-proof seal to prevent moisture from reaching the circuit substrate in the frame such that an outward facing surface of the tiling substrate is recessed from respective ends of the plurality of sidewalls thereby forming a recessed shelf space along the recessed portion of the wall upon installation of the preformed niche; and a remote to control the array of light generating sources, wherein the method of the installation of the preformed niche kit comprises:

inserting the preformed niche kit into the recessed portion of the wall;

securing the preformed niche kit in a fixed position;

connecting the electrical power connection to the power source within the wall;

connecting the remote to the circuit substrate;

applying the tiling adhesive to the tiling substrate and to the plurality of sidewalls;

applying at least one tile that is at least partially translucent to the tiling substrate in the cavity; and applying at least one tile to each of the plurality of sidewalls.

10. The apparatus according to claim 9, wherein:

the tiling substrate is configured to transmit light emitting from the circuit substrate.

11. The apparatus according to claim 9, wherein the circuit substrate includes at least one of: light-emitting diodes (LED), organic light-emitting diodes (OLED), or thin film EL (TFEL).

12. The apparatus according to claim 9, wherein the material of the tiling substrate is at least one of translucent or light diffusive, and includes one of: acrylic, polycarbonate, polyvinyl chloride, or polyethylene terephthalate.

13. The apparatus according to claim 9, wherein the remote controls the array of light generating sources disposed within the circuit substrate via one of: Bluetooth, local area network, internet, radio frequency or infrared frequency.

14. The apparatus according to claim 10, wherein the frame includes a hole through the backing panel via which wiring from the electrical power connection of the circuit substrate passes.

15. The apparatus according to claim 9, wherein the electrical power connection includes a locking connector configured to connect to a hardwire line.

16. The apparatus according to claim 9, wherein the fastener includes an adhesive.

* * * * *